US005670968A

United States Patent [19]

Inanaga et al.

[11] Patent Number: 5,670,968

[45] Date of Patent: Sep. 23, 1997

[54] RETRACTABLE FLEXIBLE TRANSMIT/ RECEIVE ANTENNA WHICH OPERATES IN A COLLAPSED AND EXTENDED POSITION

[75] Inventors: Masayuki Inanaga, Kasuga; Shouichirou Okuda, Fukuoka, both of Japan

[73] Assignee: Matsushita Electric Industrial Co., Ltd., Osaka, Japan

[21] Appl. No.: 93,944

[22] Filed: Jul. 21, 1993

Related U.S. Application Data

[63] Continuation-in-part of Ser. No. 773,878, Nov. 4, 1991, Pat. No. 5,258,772.

[30] Foreign Application Priority Data

Apr. 4, 1990 [JP] Japan ..... 2-89918

[51] Int. Cl.[6] ..... H01Q 1/10; H01Q 1/24

[52] U.S. Cl. ..... 343/901; 343/702; 343/895

[58] Field of Search ..... 343/702, 749, 343/750, 752, 889, 895, 900, 901, 903; H01Q 1/24, 1/36, 1/10

[56] References Cited

U.S. PATENT DOCUMENTS

| | | | |
|---|---|---|---|
| 2,214,685 | 9/1940 | Ston, Jr. | 343/901 |
| 2,222,527 | 11/1940 | Boughter | 343/901 |
| 2,419,611 | 4/1947 | Walsh | 343/901 |
| 2,491,629 | 12/1949 | Vernier et al. | 343/901 |
| 2,913,073 | 11/1959 | Wendling | 343/901 |
| 3,116,691 | 1/1964 | Tatel et al. | 343/702 |
| 3,254,344 | 5/1966 | Rohrs | 343/901 |
| 3,359,559 | 12/1967 | Guinn | 343/901 |
| 3,737,912 | 6/1973 | Cribb | 343/880 |
| 5,243,355 | 9/1993 | Emmert et al. | 343/895 |
| 5,245,350 | 9/1993 | Sroka | 343/702 |
| 5,258,772 | 11/1993 | Inanaga et al. | 343/702 |
| 5,526,005 | 6/1996 | Kro | 343/702 |

*Primary Examiner*—Donald T. Hajec
*Assistant Examiner*—Tan Ho
*Attorney, Agent, or Firm*—Pollock, Vande Sande & Priddy

[57] ABSTRACT

A retractable antenna device includes a flexible antenna composed of a coiled antenna conductor covered with an inner antenna cover, a tubular outer antenna case telescopically assembled with the inner antenna case for sliding movement of the flexible antenna relative the outer antenna case, a tension coil spring formed of an electrically conductive material and connected between the coiled antenna conductor and the outer antenna case, and holding means disposed on the base of the flexible antenna for holding the flexible antenna against displacement relative to the outer antenna case. With this construction, when the flexible antenna is pulled out from, or retracted into, the outer antenna case, the tension coil spring is extended or contracted. The coil spring, as it is contracted, serves as a short antenna coil so that the necessary antenna characteristics can be maintained even when the flexible antenna is received inside the antenna case. The antenna device can be transported while it is received in a pocket or the like of the user, with the main antenna kept in a retracted position, and with its receiver function kept in an activated condition.

19 Claims, 2 Drawing Sheets

RETRACTABLE FLEXIBLE TRANSMIT/ RECEIVE ANTENNA WHICH OPERATES IN A COLLAPSED AND EXTENDED POSITION

CROSS-REFERENCE TO THE RELATED APPLICATION

This application is a continuation-in-part of application Ser. No. 07/773,878, filed Nov. 4, 1991 under 35 USC 371, now U.S. Pat. No. 5,258,772.

BACKGROUND OF THE INVENTION

1. Field of the Invention

This invention relates to an antenna device, and more particularly to a retractable antenna device.

2. Description of the Prior Art

Antennas incorporated for radio wave radiation in handy-type compact radio communication equipment, movable units of cordless telephone sets, etc. include a telescopic rod antenna which is used from the point of view of portability, transportation and storage, and a flexible antenna which is used from the point of view of protection of the antenna body against damage.

FIGS. 4 and 5 show a radiotelephone equipped with a conventional flexible antenna which can be received in a body of the radiotelephone. In these figures, numeral 31 is a flexible antenna having an internal spiral conductor 32, numeral 34 is a stopper provided at the base of the flexible antenna, and numeral 35 is a bearing provided within a cabinet 38 for slidably holding the flexible antenna 31. Thus, the flexible antenna 31 is slidably supported by the bearing 35 and is protected by the stopper 34 against removal from the cabinet 38. Numeral 36 is an electrode strip provided on the base of the flexible antenna 31. The electrode strip 36 and the internal spiral conductor 32 are held in conduction with each other. Numeral 37 is an electrode strip secured to the bearing 35. When the flexible antenna 31 is pulled out as shown in FIG. 4, the electrode strip 36 and the electrode strip 37 contact with each other, thereby electrically connecting the spiral conductor 32 and transmitter and receiver circuits (not shown).

In the unused condition, the flexible antenna 31 is received within the cabinet 38, as shown in FIG. 5. In use, the user pulls out the flexible antenna 31 from the cabinet 38 while gripping the front end of the flexible antenna 31. When the flexible antenna 31 is fully extended, the electrode strip 36 on the flexible antenna side is brought into contact with the electrode strip 37 secured to the bearing 35, whereupon the transmitter and receiver circuits and the spiral conductor 32 are electrically connected with each other.

With this construction, transmission and reception of a message is not possible until the flexible antenna 31 is fully pulled out from the cabinet, as shown in FIG. 4.

In some instances, however, it is desired that a receiver function is kept alive even when the antenna is received in the cabinet. This is because it is very convenient for the user if the radiotelephone has a construction enabling such a manner of use that the radiotelephone is held compactly in a pocket or the like of the user while keeping the receiver function in an activated condition, and when a call signal is received, the user draws the radio-telephone from the pocket and pulls out the antenna from the cabinet for commencing transmission of a message. To realize this manner of use, however, a receive-only sub-antenna which is operable in the received condition must be provided within the cabinet in addition to the main antenna. Furthermore, in order to connect the transmitter and receiver circuits selectively with the main antenna and the sub-antenna depending on the position of the main antenna, a switching means must be provided. Thus, the above-mentioned arrangement increases the number of structural components of the radiotelephone.

Furthermore, when the antenna of the construction shown in FIG. 4 is depressed during transmission of a message, connection between the antenna and the transmitter circuit is interrupted for a moment. In this instance, the impedance and the resonance frequency of the antenna side as viewed from the transmitter circuit change greatly. If such a great change in impedance and resonance frequency occurs during the transmission of a message, the transmitter circuit may be damaged.

The currents flowing between the transmitter circuit and the main antenna and also between the transmitter circuit and the sub-antenna are high-frequency currents in a radio frequency band. Contacts of the switching means must be disposed at portions through which the high-frequency currents flow. In order to minimize a high-frequency current loss, an expensive switching means is needed, which will increase the manufacturing cost of the radiotelephone.

SUMMARY OF THE INVENTION

This invention was made in view of the foregoing problems, and is to provide an antenna device which is equipped with a retractable flexible antenna as a main antenna, is capable of maintaining a receiver function even when the flexible antenna is retracted, and can be manufactured at a low cost and is highly reliable in operation.

In brief, an antenna device according to this invention comprises a main antenna slidably received in a tubular antenna case, a coil spring composed of a conductor and secured at one end to a base portion of the main antenna and, at an opposite end, to the antenna case, and holding means disposed on the base portion and engageable in pressure contact with an inner wall of the antenna case for holding the main antenna in position against displacement.

With this construction, when the main antenna is retracted into the antenna case, the coil spring is contracted. The coil spring formed from a conductor has electric qualities of a coil. The inductance of the coil increases when the coil is contracted. Thus, the coil spring serves as a short antenna coil by means of which the necessary characteristic of the antenna can be maintained even when the main antenna is held in its retracted position. Consequently, the user is able to carry the radiotelephone while holding it in a pocket or the like, with the main antenna received in a body of the radiotelephone, and with a receiver function kept alive. The receive-only built-in antenna and the switching means described above are no longer needed, so that a highly reliable antenna device can be obtained at a low cost.

In one aspect the present invention provides an antenna device which comprises an antenna case composed of an inner case and an outer case telescopically assembled together and slidably movable relative to one another so as to extend and contract the length of the antenna case, and an antenna conductor received in the antenna case and having a coiled resilient portion. The coiled resilient portion of the antenna conductor is extendable and contractible in response to the movement of the inner case relative to the outer case. The coiled resilient portion of the antenna conductor may be comprised of a tension coil spring. The antenna device may further include a means for holding the inner and outer cases in position against displacement relative to one another.

In an antenna device provided in accordance with another aspect the present invention, the antenna conductor as a whole is a coiled antenna conductor, and at least a portion of the coiled antenna conductor is extendable and contractible in response to the movement of the inner case relative to the outer case.

Preferably, the antenna conductor is connected at one end to the inner case and, at an opposite end, to the outer case. A metallic terminal may be attached to an end of the outer case, in which instance the opposite end of the antenna conductor is electrically connected to the metallic terminal.

The above and other objects, features and advantages of the present invention will become more apparent to those versed in the art when making reference to the detailed description and accompanying sheets of drawings in which a preferred structural embodiment incorporating the principles of the present invention is shown by way of illustrative example.

DETAILED DESCRIPTION OF THE INVENTION

An embodiment of this invention will be described below with reference to the accompanying drawings.

Figure 1:
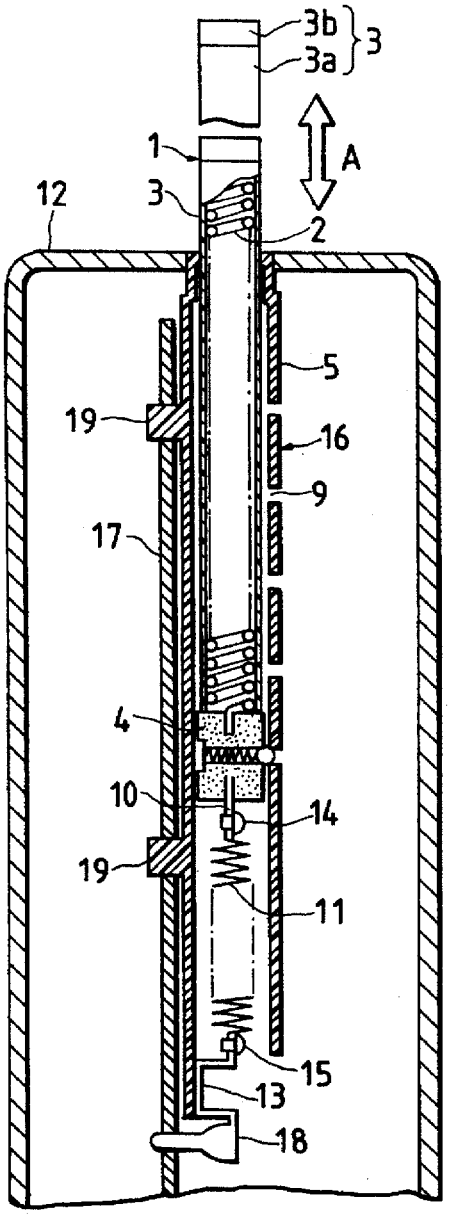
FIG. 1 is a across-sectional view of an antenna device according to an embodiment of this invention.
Figure 3:
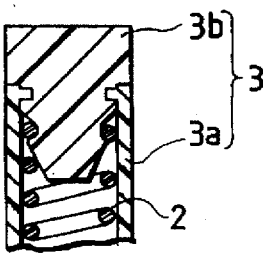
FIG. 3 is an enlarged cross-sectional view of a portion of a flexible antenna of the antenna device, showing the connection between an antenna conductor and an antenna case.
Figure 4:
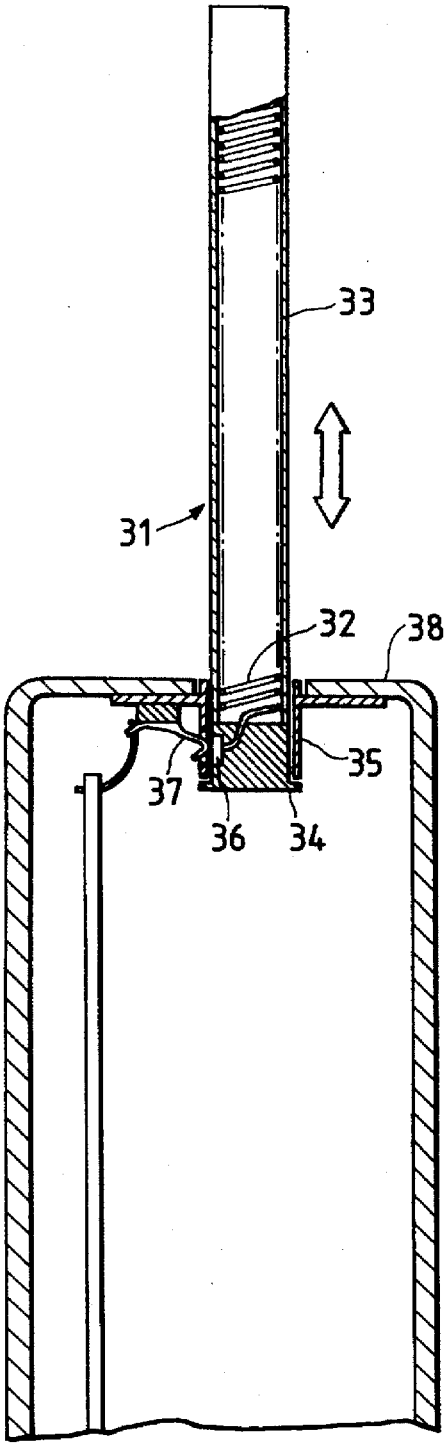
FIG. 4 PRIOR ART
FIG. 4 is a cross-sectional view of an antenna device having a conventional flexible antenna being used.
Figure 5:
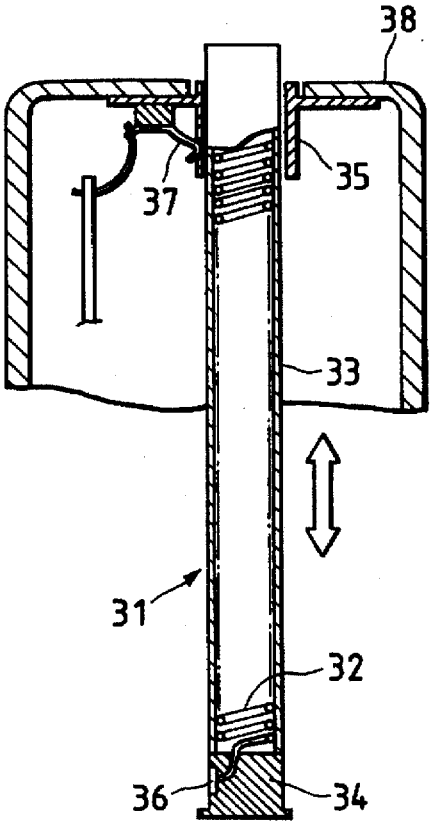
FIG. 5 PRIOR ART
FIG. 5 is a cross-sectional view of the conventional antenna device shown in a retracted condition.

FIG. 1 is a cross-sectional view of an antenna mounting portion of a cordless telephone having a retractable antenna device embodying the present invention. The retractable antenna device includes a flexible antenna 1 composed of a spiral or coiled conductor 2 and a sheath 3 covering the coiled conductor 2. The sheath 3 is made of an electrically insulating material, such as a synthetic resin, and forms an inner antenna case. In the illustrated embodiment, the inner antenna case (sheath) 3 is composed of a tubular case body 3*a* and an end cap 3*b* attached by press-fitting to an end (forward end) of the case body 3*a* to close the forward end of the case body 3*a*, with the coiled conductor 2 is received in the inner case 3. The coiled conductor 2 has one end (forward end) connected to the end cap 3*b* of the inner antenna case 3, as shown in FIG. 3. The tubular case body 3*a* is molded of polyester elastomer, and the end cap 3*b* is molded of acrylonitrile-butadiene-styrene (ABS) resin. The coiled conductor 2 is formed from a hard steel wire.

Numeral 4 is a slide member provided at an opposite end (base) of the coiled conductor 2. Numeral 5 is an antenna case constructed into a tubular form in which the flexible conductor 1 covered with the inner antenna case (sheath) 3 is slidably received and movable longitudinally in the direction indicated by the arrow A. The antenna case 5 is made of an electrically insulating material, such as a synthetic resin, and forms an outer antenna case of the retractable antenna device of this invention. The inner antenna case 3 and the outer antenna case 5 are telescopically assembled together so as to jointly constitute an antenna case. The inner and outer antenna cases 3, 5 thus assembled are slidably movable relative to one another so as to extend or contract the length of the antenna case. In the illustrated embodiment, the outer antenna case 5 is molded of polyphenylene oxide.

Figure 2:
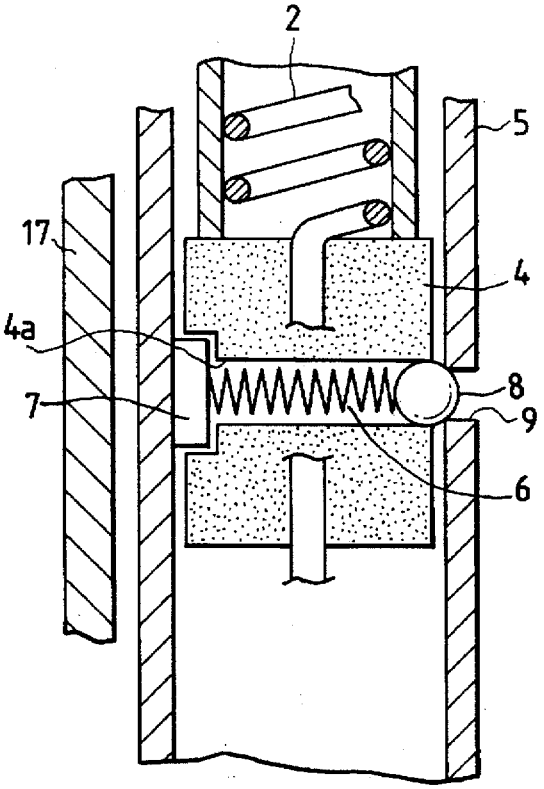
FIG. 2 is an enlarged cross-sectional view of a main portion of the antenna device.

FIG. 2 shows structural details of the slide member 4. Numeral 6 is a compression coil spring, 7 is a friction plate, and 8 is an iron ball. The iron ball 8 is disposed on one side of the slide member 4 while the friction plate 7 is disposed on the opposite side of the slide member 4. The spring 6 is received in a transverse through-hole 4*a* formed in the slide member 4 and urges the iron ball 8 and the friction plate 7 away from one another. The friction plate 7 is, therefore, forced against an inner wall of the outer antenna case 5 to produce a friction force therebetween.

Numeral 9 is one of plural holes formed in an inner wall of the outer antenna case 5. The holes 9 are arranged along the longitudinal direction of the outer antenna case 5. The iron ball 8 is urged by the spring 6 toward the inner wall of the outer antenna case 5 so that the iron ball 8 can be fitted in each of the holes 9.

The base portion of the coiled conductor 2 is formed straight. The straight base portion extends through the slide member 4 and terminates in an end (rear end) which constitutes an electrode portion 10.

Numeral 11 shown in FIG. 1 is a tension coil spring for urging the flexible antenna 1 inwardly, that is, in such a direction as to pull the flexible antenna 1 into the outer antenna case 5. The coil spring 11 is made of an electrically conductive material such as stainless steel. One end of the coil spring 11 is secured by a screw 14 to the electrode portion 10 so that the coil spring 11 and the coiled conductor 2 are electrically connected together. Numeral 13 is a fastening metal disposed at an end of the outer antenna case 5 so as to form a metallic terminal. The opposite end of the coil spring 11 is secured by a screw 15 to the fastening metal (metallic terminal) 13 so that the coil spring 11 and the fastening metal (metallic terminal) 13 are electrically connected together.

The coiled conductor 2 and the coil spring 11 are electrically conductive and jointly form an antenna conductor. The antenna conductor thus constructed is received in the antenna case. More particularly, the antenna conductor is received in a space defined by the inner antenna case 3 and the outer antenna case 5. At least the coil spring 11, due to its resiliency, is extendable and contractible in response the sliding movement of the inner antenna case 3 relative to the outer antenna case 5 when the flexible antenna 1 projects from, or is retracted into, the outer antenna case 5.

It is possible, according to the present invention, to form the coil spring 11 and the coiled conductor 2 as a single coiled antenna conductor of an integral structure. In this case, the single coiled antenna conductor has a coiled first conductor portion which corresponds to the coiled conductor 2 and is received in the inner antenna case 3 with its one end connected to the forward end of the inner case 3, and a coiled second conductor portion which corresponds to the coiled spring 11 and is received in the outer antenna case 5 with its one end contiguous to the opposite end of the coiled first conductor portion. The opposite end of the coiled second conductor portion is connected to the fitting metal (metallic terminal) 13. The single coiled antenna conductor is resilient and is capable of extending and contracting in response to the movement of the inner antenna case 3 relative to the outer antenna case 5 when the flexible antenna 1 is projected from, or retracted into, the outer antenna case 5. The slide member 4 which is equipped with the antenna holding means composed of the spring-loaded iron ball 8 may be attached by injection-molding, for example, to the junction between the coiled first conductor portion and the coiled second conductor portion, in which instance, at least the coiled second conductor portion is extendable and contractible when the flexible antenna 1 is pull out from, or retracted into, the outer antenna case 5.

The above-mentioned part, namely a part which is composed of the flexible antenna 1 including the coiled conductor 2 and the inner antenna case 3, the slide member 4, the outer antenna case 5, the coil spring 11 and the fastening metal 13 is called a retractable antenna unit or device 16.

Numeral 17 is a printed circuit board having formed thereon a transmitter and a receiver circuit, etc. (not shown). Numeral 18 is a terminal pin formed integrally with the fastening metal (metallic terminal) 13. The terminal pin 18 is soldered with a conductor foil on a printed circuit board 17 so that it is electrically connected with the transmitter and receiver circuits formed on the printed circuit board 17. Bosses 19 projecting from the outer antenna case 5 are fitted with holes formed in the printed circuit board 17 so as to attach the antenna unit 16 to the printed circuit board 17.

Hereinafter, a description will be given of the procedure for assembling the retractable antenna device.

Firstly, the coiled conductor 2 of the flexible antenna 1 is attached to the slide member 4. Then, the tubular inner case body 3*a* is fitted over the coiled conductor 2, and after that the end cap 3*b* is attached by press-fitting to the forward end of the inner case body 3*a*. At this time, the forward end of the coiled conductor 2 is connected to the end cap 3*b* which is located at the forward end of the inner antenna case 3. Thus, the flexible antenna 1 is assembled.

Then, the electrode portion 10 of the coiled conductor 2 is connected by the screw 14 to the coil spring 11, and the fastening metal (metallic terminal) 13 is connected by the screw 15 to the coil spring 11. Thereafter, the flexible antenna 1 is inserted into the outer antenna case 5. In this instance, the iron ball 8, the spring 6 and the friction plate 7 are also inserted into the outer antenna case 5 while they are held in an assembled condition within the hole 4*a* in the slide member 4, as shown in FIG. 2. Subsequently, the coil spring 11 and the fastening metal 13 are inserted in sequence into the outer antenna case 5, and the fastening metal 13 is thereafter attached to the outer antenna case 5.

Subsequently, the outer antenna case 5 with parts received therein is attached to the printed circuit board 17, and the terminal pin 18 is then soldered to a conductor foil on the printed circuit board 17. Finally, the printed circuit board 17 with the antenna unit 16 attached thereto is inserted into a cabinet 12.

Hereinafter, a description will be given of the operation of the retractable antenna device mentioned above. The flexible antenna 1 is slidable in the direction of the arrow A within the outer antenna case 5, as described above. In response to the movement of the flexible antenna 1, the coil spring 11 undergoes axial expansion and contraction. The axially expandable and contractible coil spring 11 forms a part of the antenna conductor 2, as described above. When the flexible antenna 1 is received in the cabinet 12, the coil spring 11 is contracted. The thus-contracted coil spring 11 means that the inductance of the coil spring 11 is increased. The coil spring 11 having such an larger inductance serves as a short antenna coil.

As described above, since the coil spring 11 serves as a short antenna coil, the impedance and the resonance frequency of the antenna side as viewed from the transmitting circuit do not change greatly even when the length of the antenna is shortened by retracting the flexible antenna 1 into the cabinet 12 (viz., the outer antenna case 5). The necessary characteristics of the antenna can, therefore, be maintained. As a consequence, radio waves can be caught or received even when the flexible antenna 1 is received in the cabinet 12.

Furthermore, the slidable main antenna, namely the flexible antenna 1 is always connected to the transmitter and receiver circuits of the printed circuit board 17 via the coil spring 11. This arrangement obviates the intervention of a contact terminal and thereby eliminates an imperfect contact problem.

When the receive mode is shifted to the transmission mode, the user pulls out the flexible antenna 1 while gripping the front end of the flexible antenna 1. The flexible antenna 1, as it is withdrawn from the outer antenna case 5, extends the coil spring 11 whereupon the coil spring 11, due to its resiliency, creates a force tending to pull the flexible antenna 1 back into the outer antenna case 5. In this instance, the iron ball 8 fits in one of the holes 9 to lock the slide member 4 against movement relative to the outer antenna case 5, thereby holding the flexible antenna 1 in an extended position. The friction plate 7 which is provided on the opposite side to the iron ball 8 is forced against the inside wall of the outer antenna case 5. Accordingly, an adequate friction is generated between the friction plate 7 and the outer antenna case 5.

During movement, the iron ball 8 makes a click each time when it snaps into one of the holes 9 in the outer antenna case 5. With the click stop thus provided, the flexible antenna 1 can be displaced easily with a relatively small force.

Obviously, various minor changes and modifications of the present invention are possible in the light of the above teaching. It is therefore to be understood that within the scope of the appended claims the invention may be practiced otherwise than as specifically described.

What is claimed is:

1. An antenna device comprising:

an antenna insulated case composed of an inner case of electrically insulating material and an outer case of electrically insulating material telescopically assembled together and slidably movable relative to one another so as to extend and contract the length of said antenna case; and an antenna conductor enclosed within said antenna case and having a coiled resilient portion of said antenna conductor being extendable and contractible in response to the movement of said inner case relative to said outer case.

2. An antenna device according to claim 1, wherein said antenna conductor is connected at one end to said inner case and, at an opposite end, to said outer case.

3. An antenna device according to claim 2, further including a metallic terminal attached to an end of said outer case, and electrically connected to said opposite end of said antenna conductor.

4. An antenna device according to claim 1, wherein said antenna conductor includes a coiled first conductor portion and a coiled second conductor portion contiguous to said coiled first conductor portion, said coiled second conductor portion forming said coiled resilient portion, said coiled first conductor portion being received in said inner case and connected at an end to said inner case, said coiled second conductor portion being received in said outer case and connected at an end to said outer case.

5. An antenna device according to claim 4, further including a metallic terminal attached to an end of said outer case, and electrically connected to said end of said coiled second conductor portion of said antenna conductor.

6. An antenna device according to claim 1, further including means for holding said inner and outer cases in position against displacement relative to one another from a spring force exerted by said coiled resilient portion between said inner and outer cases.

7. An antenna device comprising:

an insulated antenna case composed of an electrically insulated inner case and an electrically insulated outer case telescopically assembled together and slidably movable relative to one another so as to extend and contract the length of said antenna case; and a coiled antenna conductor enclosed within said antenna case, at least a portion of said coiled antenna conductor being extendable and contractible in response to the movement of said inner case relative to said outer case.

8. An antenna device according to claim 7, wherein said coiled antenna conductor is connected at one end to said inner case and, at an opposite end, to said outer case.

9. An antenna device according to claim 8, further including a metallic terminal attached to an end of said outer case and connected to said opposite end of said coiled antenna conductor.

10. An antenna device according to claim 7, wherein said coiled antenna conductor includes a coiled first conductor portion and a coiled second conductor portion contiguous to said coiled first conductor portion, said coiled second conductor portion forming said portion of said coiled antenna conductor, said coiled first conductor portion being received in said inner case and connected at an end to said inner case, said coiled second conductor portion being received in said outer case and connected at an end to said outer case.

11. An antenna device according to claim 10, further including a metallic terminal attached to an end of said outer case, said end of said coiled second conductor portion of said coiled antenna conductor being electrically connected to said metallic terminal.

12. An antenna device according to claim 7, further including means for holding said inner and outer cases in position against displacement relative to one another from a spring force exerted by said portion of said coiled conductor between said inner and outer cases.

13. An antenna device comprising:

an antenna case composed of an inner case and an outer case telescopically assembled together and slidably movable relative to one another so as to extend and contract the length of said antenna case, each of said inner and outer cases being made of an electrically insulating material;

a metallic terminal attached to an end of said outer case; and an antenna conductor received in said antenna case and having a coiled resilient portion, said antenna conductor having one end connected to said inner case, and an opposite end electrically connected to said metallic terminal, said resilient coiled portion of said antenna conductor being extendable and contractible in response to the movement of said inner case relative to said outer case.

14. An antenna device according to claim 13, wherein said antenna conductor includes a coiled first conductor portion and a contiguous coiled second conductor portion contiguous to said coiled first conductor portion, said coiled second conductor portion forming said coiled resillent portion, said coiled first conductor portion being received in said inner case and connected at an end to said inner case, said coiled second conductor portion being received in said outer case and connected at an end to said metallic terminal.

15. An antenna device according to claim 14, wherein said coiled second conductor portion is a tension coil spring.

16. An antenna device according to claim 14, wherein said coiled second conductor portion is a tension coil spring, and which further includes means for holding said inner and outer cases in position against displacement relative to one another.

17. An antenna device comprising:

a longitudinal electrically insulated inner case containing therein a coiled conductor which extends over a major portion of said inner case having one end connected to a closed end of said inner case, and an opposite free end extending through a second end of said inner case;

a slide member closing said second end of said inner case having a through hole which carries said free end;

an electrically insulated outer case through which said inner case slides, including a means for engaging said slide member retaining said inner case and outer case in one of a plurality of respective telescopic positions; and, a tension spring connected to apply a retracting force between said inner case and outer case when said inner case and outer case are disengaged, permitting said inner case to be retracted into said outer case.

18. The antenna device of claim 17, wherein said slide member means for engaging comprises a friction plate for engaging said outer case, and a spring-loaded ball which engages one of a plurality of holes in said outer case.

19. The antenna device of claim 17, wherein said tension spring is connected at one end to said free end of said coiled conductor and which is connected at a second end to a metallic terminal attached to said outer case.

* * * * *